US010465429B2

(12) United States Patent
Koiso

(10) Patent No.: US 10,465,429 B2
(45) Date of Patent: Nov. 5, 2019

(54) CONTROLLER, CONTROL METHOD, AND COMPUTER-READABLE RECORDING MEDIUM

(71) Applicant: JVC KENWOOD Corporation, Yokohama-shi (JP)

(72) Inventor: Hisashi Koiso, Yokohama (JP)

(73) Assignee: JVC KENWOOD Corporation, Yokohama-shi (JP)

( * ) Notice: Subject to any disclaimer, the term of this patent is extended or adjusted under 35 U.S.C. 154(b) by 674 days.

(21) Appl. No.: 14/942,545

(22) Filed: Nov. 16, 2015

(65) Prior Publication Data

US 2016/0138318 A1 May 19, 2016

(30) Foreign Application Priority Data

Nov. 19, 2014 (JP) ..... 2014-234561

(51) Int. Cl.
*E05F 1/00* (2006.01)
*E05F 15/00* (2015.01)
*G07C 9/00* (2006.01)

(52) U.S. Cl.
CPC ..... *E05F 1/002* (2013.01); *E05F 15/00* (2013.01); *G07C 9/00309* (2013.01); *E05Y 2900/531* (2013.01); *G07C 2209/63* (2013.01)

(58) Field of Classification Search
CPC .... E05F 15/00; E05F 1/002; E05Y 2900/531; G07C 2209/63; G07C 9/00309
USPC ..... 348/148
See application file for complete search history.

(56) References Cited

U.S. PATENT DOCUMENTS

2008/0117020 A1* 5/2008 Martin ..... B66B 13/26 340/5.7
2011/0248820 A1* 10/2011 Gehin ..... G07C 9/00309 340/5.72
2012/0249291 A1 10/2012 Holcomb et al.
(Continued)

FOREIGN PATENT DOCUMENTS

DE 102006037237 A1 2/2008
DE 102008021989 A1 * 12/2008 ..... B60Q 1/323
DE 102008021989 A1 12/2008
(Continued)

OTHER PUBLICATIONS

Extended European Search Report in European Patent Application No. 15195210.8, dated Apr. 22, 2016.
(Continued)

*Primary Examiner* — William C Vaughn, Jr.
*Assistant Examiner* — Naod W Belai
(74) *Attorney, Agent, or Firm* — Amin, Turocy & Watson LLP

(57) ABSTRACT

A controller includes an imaging unit, a reception unit, a detection unit, and an opening/closing control unit. The imaging unit acquires an image of a peripheral area P of an opening/closing body provided in a main body part (vehicle body). The reception unit receives, from a first terminal that transmits a first signal of a predetermined strength, the first signal. The detection unit detects a motion of a subject included in the image. The opening/closing control unit controls an opening operation of the opening/closing body when a change in a reception strength of the first signal received by the reception unit represents a change synchronizing with the detected motion of the subject.

5 Claims, 9 Drawing Sheets

(56) References Cited

U.S. PATENT DOCUMENTS

| | | | | |
|---|---|---|---|---|
| 2013/0156433 | A1* | 6/2013 | Blair | H03K 17/941 398/106 |
| 2015/0254913 | A1 | 9/2015 | Obata et al. | |

FOREIGN PATENT DOCUMENTS

| | | | |
|---|---|---|---|
| JP | 2005-315024 | A | 11/2005 |
| JP | 2012-504716 | A | 2/2012 |
| JP | 2013-117134 | A | 6/2013 |
| WO | 2010/037738 | A1 | 4/2010 |
| WO | WO-2013/082725 | A1 | 6/2013 |
| WO | WO-2014/041955 | A1 | 3/2014 |

OTHER PUBLICATIONS

Notification of Reasons for Refusal in counterpart Japanese Patent Application No. 2014-234561, dated Jul. 4, 2017.

* cited by examiner

| MOTION | CHANGE IN RECEPTION STRENGTH |
|---|---|
| | |
| | |
| | |

| USER IDENTIFICATION INFORMATION | USE AUTHORITY |
|---|---|
| A | OPENING/CLOSING AUTHORITY |
| B | · |
| · | · |

CONTROLLER, CONTROL METHOD, AND COMPUTER-READABLE RECORDING MEDIUM

CROSS-REFERENCE TO RELATED APPLICATION(S)

The present application claims priority to and incorporates by reference the entire contents of Japanese Patent Application No. 2014-234561 filed in Japan on Nov. 19, 2014.

BACKGROUND OF THE INVENTION

1. Field of the Invention

The present invention relates to a controller, a control method, and a computer-readable recording medium.

2. Description of the Related Art

There is known a system that opens/closes an opening/closing body such as a door provided in a vehicle without user's touch on the opening/closing body (see, for example, Japanese Laid-open Patent Publication No. 2013-117134 and Japanese Laid-open Patent Publication No. 2005-315024).

For example, Japanese Laid-open Patent Publication No. 2013-117134 discloses a system that photographs a marker set in a vehicle, determines whether or not the marker is included in a photographed image, to execute an opening operation of a rear opening/closing body located near the marker. Further, Japanese Laid-open Patent Publication No. 2005-315024 discloses an apparatus that opens a door or a window corresponding to an empty space in the interior of a vehicle when baggage is included in an image of passengers photographed by a vehicle exterior camera.

However, conventionally, there may be a case where an opening/closing body that need not be opened is opened, that is, a malfunction may occur.

SUMMARY OF THE INVENTION

It is an object of the present invention to at least partially solve the problems in the conventional technology.

There is provided a controller that includes an imaging unit that acquires an image of a peripheral area of an opening/closing body provided in a main body part, a reception unit that receives, from a first terminal that transmits a first signal of a predetermined strength, the first signal, a detection unit that detects a motion of a subject included in the image, and an opening/closing control unit that controls an opening operation of the opening/closing body when a change in a reception strength of the first signal received by the reception unit represents a change synchronizing with the detected motion of the subject.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A controller, a control method, and a computer-readable recording medium according to an embodiment will be described in detail with reference to the accompanying drawings.

Figure 1:
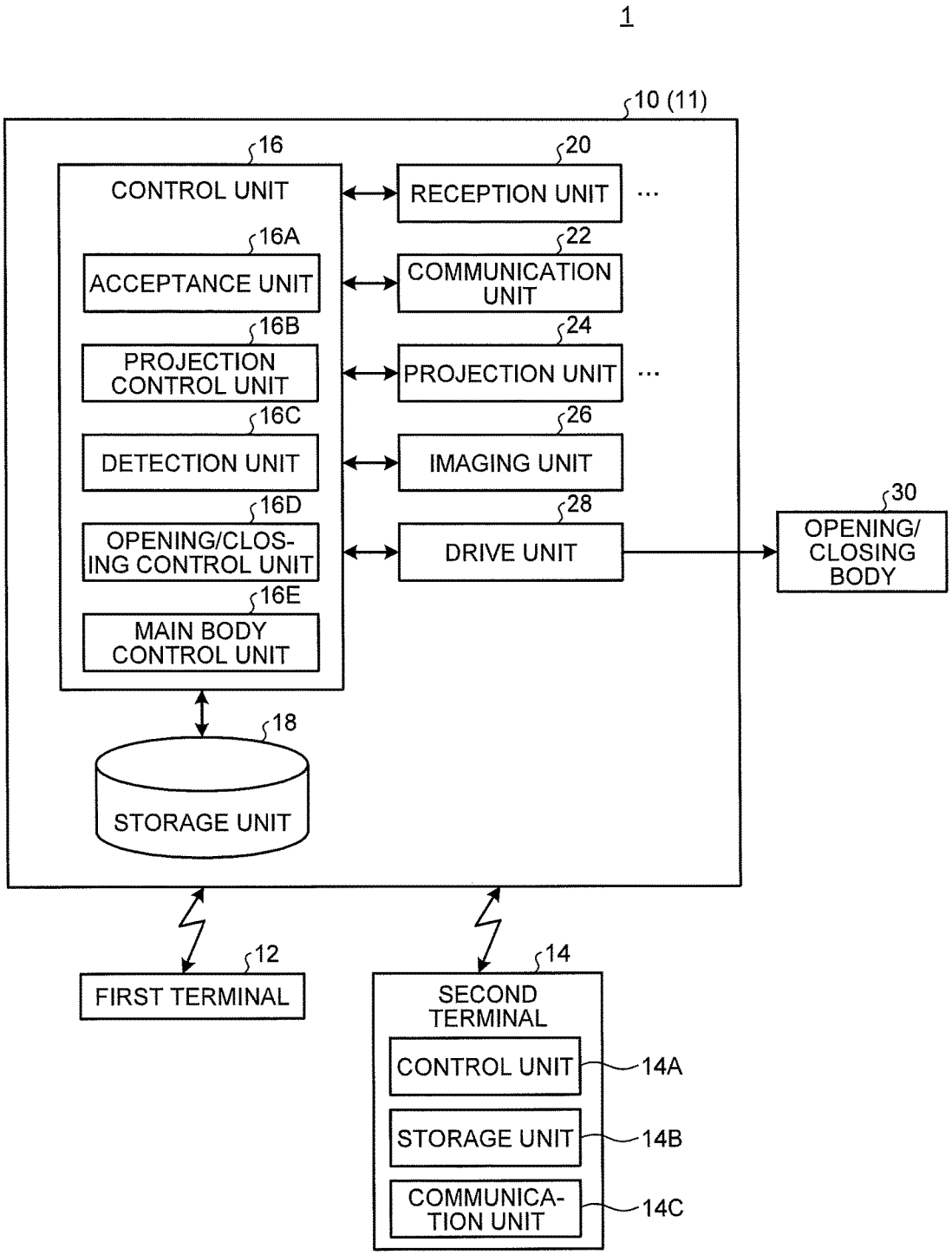
FIG. 1 is a functional block diagram illustrating an opening/closing control system according to an embodiment.

FIG. 1 is a functional block diagram illustrating an opening/closing control system 1 according to an embodiment. The opening/closing control system 1 includes a controller 10, a first terminal 12, a second terminal 14, and an opening/closing body 30. The first and second terminals 12 and 14 can perform radio communication with the controller 10.

In the present embodiment, a case where the controller 10 is mounted on a vehicle 11 is taken as an example. Further, in the present embodiment, a case where the vehicle 11 is an automobile is taken as an example. Note that the mounting object on which the controller 10 is mounted is not limited to the vehicle 11. Further, the vehicle 11 is not limited to the automobile, but may be a trailer to be towed.

The first terminal 12 is a mobile terminal that transmits a locking instruction or an unlocking instruction for the opening/closing body 30 such as a door provided in the vehicle 11. The first terminal 12 may have a function as a key for controlling operation of the vehicle 11.

In the present embodiment, the first terminal 12 transmits a first signal of a predetermined strength. The first signal transmitted from the first terminal 12 is a radio signal. The strength of the first signal is a strength detectable by a reception unit positioned in an area in which a distance from the first terminal 12 is equal to or less than a predetermined distance (hereinafter, referred to as "first distance") and a strength not detectable by a reception unit positioned in an area in which the distance from the first terminal 12 exceeds the first distance. The first distance (distance over which the first signal is transmittable) may be previously set according to a size, etc., of the opening/closing body 30 of the vehicle 11. For example, the first distance may be set according to a movable range of the opening/closing body 30. The first distance is, e.g., in a range of 1 m to 2 m.

The first terminal 12 may transmit the first signal periodically or constantly. When transmitting the first signal periodically, the first terminal 12 repeatedly transmits, every predetermined time, a pattern in which a signal of a predetermined strength continues for a predetermined time length. The predetermined time may be equal to or more than a time in which a subject performs a predetermined motion (details of which will be described later).

Figure 2A:
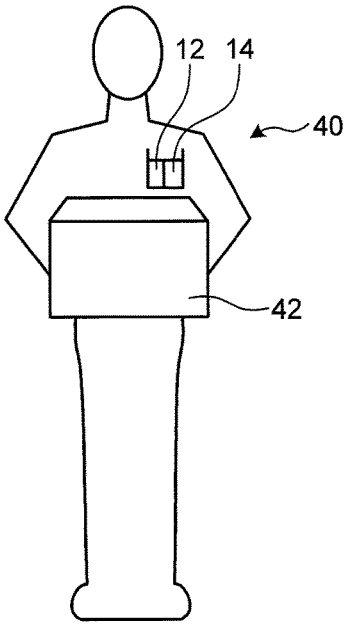
FIGS. 2A and 2B are views illustrating an example of a subject.
Figure 2B:
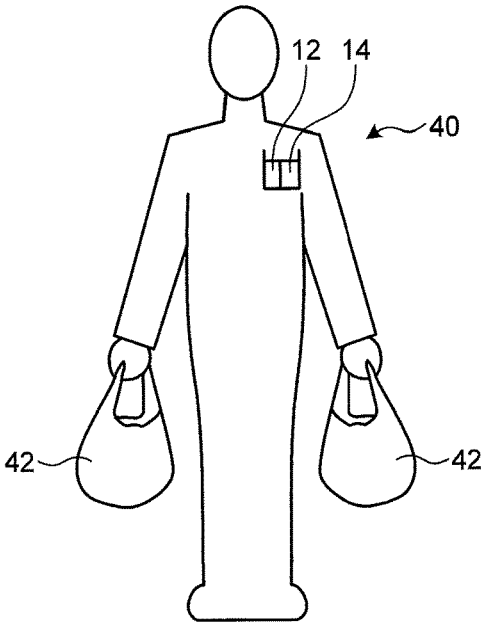

In the present embodiment, a human body is mainly used as the subject. FIGS. 2A and 2B are views illustrating an example of a subject 40. In the present embodiment, it is assumed a case where the subject 40 is a human body, and the subject 40 carries baggage 42 with both hands (FIG. 2A) or a case where the subject 40 carries baggage 42 in each hand (FIG. 2B). Further, it is assumed that the subject 40 holds the first and second terminals 12 and 14 (see FIGS. 2A and 2B).

That is, in the present embodiment, it is assumed a situation where the subject 40 carrying the baggage 42 intends to open the opening/closing body 30 such a door of the vehicle 11 without touching the opening/closing body 30.

The first terminal 12 may transmit an authentication code (ID) set between the controller 10 and the first terminal 12 in advance, the unlocking instruction, locking instruction, or the like when a switch (not illustrated) provided in the first terminal 12 is operated by a user. That is, the first terminal 12 can be used as an electronic key used in a keyless entry system.

The second terminal 14 is a known mobile terminal. The second terminal 14 is, e.g., a smartphone or a mobile tablet.

The second terminal 14 includes a control unit 14A, a storage unit 14B, and a communication unit 14C. The control unit 14A controls the second terminal 14. The storage unit 14B stores various data. In the present embodiment, the storage unit 14B stores user identification information of a user operating the second terminal 14. The communication unit 14C performs radio communication with the controller 10. The communication unit 14C uses a radio communication standard, such as wireless LAN, Bluetooth (Registered trademark), or Wi-Fi to perform radio communication with the controller 10.

In the present embodiment, the control unit 14A of the second terminal 14 receives a user identification information acquisition request from the controller 10 through the communication unit 14C. Upon receiving the user identification information acquisition request, the control unit 14A transmits, through the communication unit 14C, the user identification information stored in the storage unit 14B to the controller 10 as a transmission source of the acquisition request.

The following describes the controller 10.

The controller 10 includes a control unit 16, a storage unit 18, a reception unit 20, a communication unit 22, a projection unit 24, an imaging unit 26, and a drive unit 28 and controls operation of the opening/closing body 30. The storage unit 18, the reception unit 20, the communication unit 22, the projection unit 24, the imaging unit 26, and the drive unit 28 are each connected to the control unit 16 so as to be able to exchange data or signals with the control unit 16.

The controller 10 may include at least the control unit 16, the reception unit 20, the imaging unit 26, and the drive unit 28. That is, the controller 10 may not include at least one of the communication unit 22 and the projection unit 24. Further, an internal memory in the control unit 16 may be used as the storage unit 18 and, in this case, the storage unit 18 may be omitted.

Figure 3:
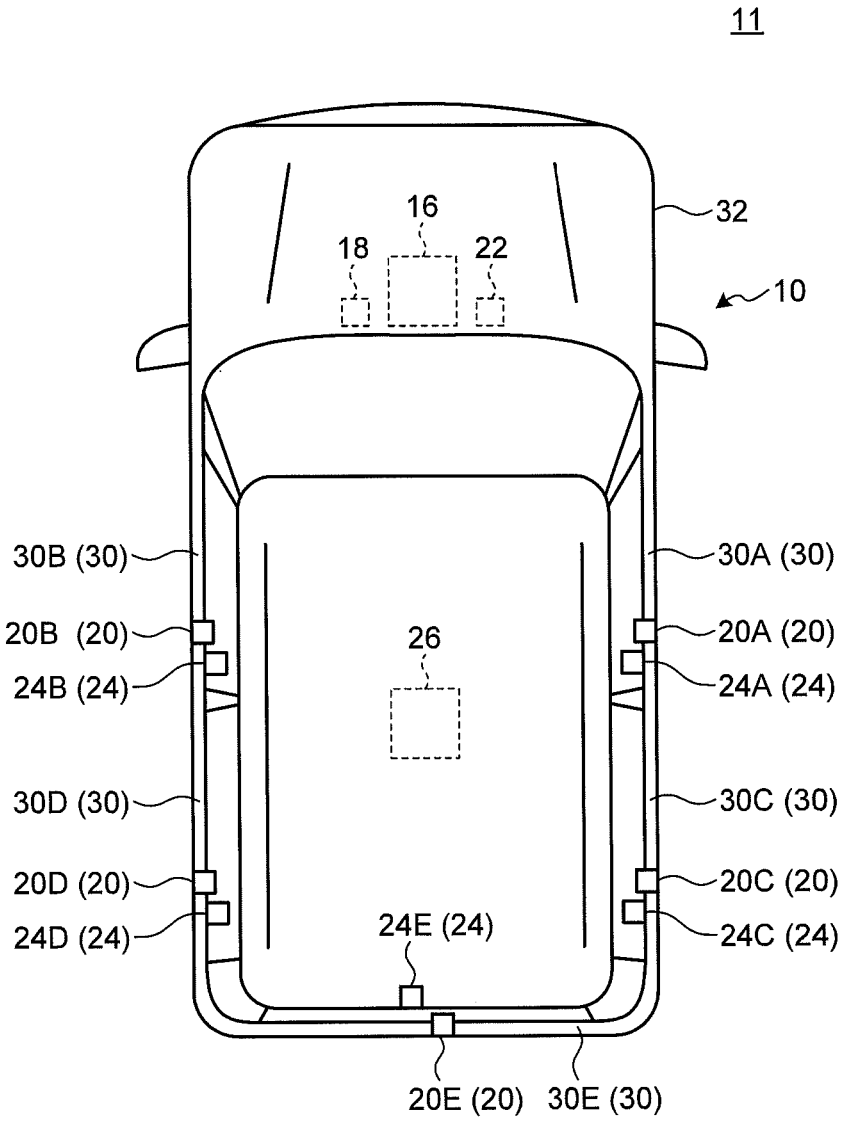
FIG. 3 is an exemplary view illustrating an example of a vehicle on which a controller is mounted.

FIG. 3 is an exemplary view illustrating an example of the vehicle 11 on which the controller 10 is mounted. The control unit 16, the storage unit 18, and the communication unit 22 are mounted on a vehicle body 32 (main body part) of the vehicle 11.

The communication unit 22 performs radio communication with the second terminal 14. The communication unit 22 uses a radio communication standard, such as wireless LAN, Bluetooth, or Wi-Fi to perform radio communication with the second terminal 14.

In the present embodiment, a plurality of opening/closing bodies 30 are provided in a vehicle body 32 (main body part). For example, in FIG. 3, five opening/closing bodies 30 (30A to 30E) are provided in the vehicle body 32. The opening/closing bodies 30A and 30B are each a door disposed at a front side of a side surface of the vehicle 11. The opening/closing bodies 30C and 30D are each a door disposed at a rear side of the side surface of the vehicle 11. The opening/closing body 30E is a door disposed at a rear side of the vehicle 11 and is a vehicle rear opening/closing door such as a trunk door.

Note that the number of the opening/closing bodies 30 provided in the vehicle body 32 is not limited. Further, an opening/closing mode of the opening/closing body 30 is not especially limited as long as at least the opening of the opening/closing body 30 can be achieved by operation of the drive unit 28, and various opening/closing modes, such as a vertical opening/closing mode, an opening/closing mode by a horizontal hinge, and a horizontal sliding opening/closing mode can be adopted.

The drive unit 28 brings the opening/closing body 30 into an opening or closing motion. The drive unit 28 selectively brings at least one of the plurality of opening/closing bodies 30 into an opening or closing motion under control of the control unit 16.

The photographing unit 26 is a known digital imaging device. The imaging unit 26 photographs a peripheral area of the opening/closing body 30 and acquires an image of the peripheral area. The image of the peripheral area photographed by the imaging unit 26 may be a moving image obtained by continuously imaging a plurality of frame images. In the present embodiment, it is assumed that the imaging unit 26 photographs the moving image of the peripheral area.

Figure 4:
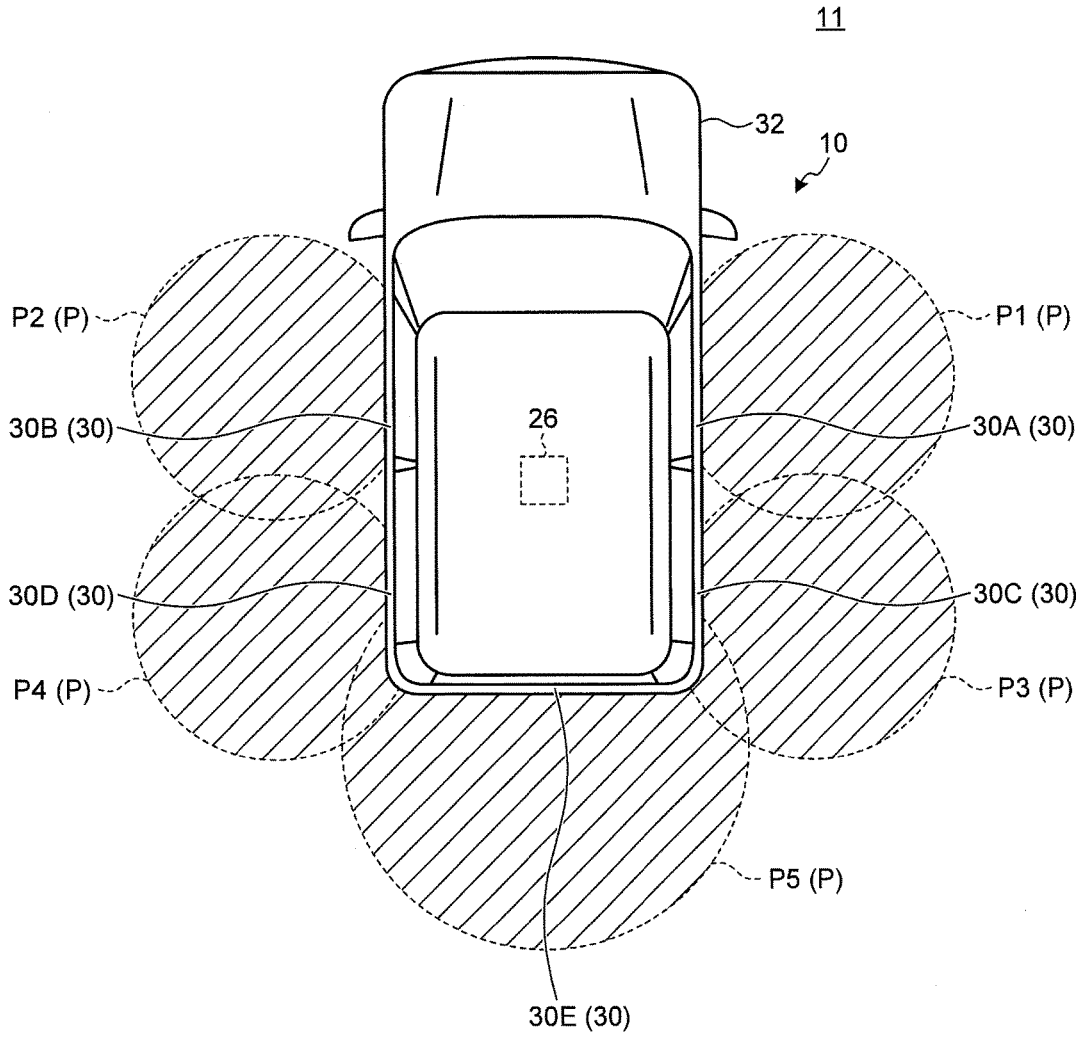
FIG. 4 is an exemplary view illustrating an imaging range of an imaging unit.

FIG. 4 is an exemplary view illustrating an imaging range of the imaging unit 26. The imaging unit 26 is disposed such that a peripheral area P (peripheral areas P1 to P5 in FIG. 4) of the opening/closing body 30 (opening/closing bodies 30A to 30E) provided in the vehicle body 32 is set as the imaging range. Each peripheral area P may have a size large enough for the subject 40 positioned in front of each opening/closing body 30 to be photographed. The size of each peripheral area P which is the imaging range of the imaging unit 26 may previously be adjusted according to a type of the vehicle body 32.

In the present embodiment, it is assumed that the controller 10 includes one imaging unit 26.

However, the controller 10 may include a plurality of imaging units 26. In this case, the plurality of imaging units 26 may each be previously adjusted in an installation position and an imaging angle such that the peripheral area P (peripheral areas P1 to P5) of a plurality of the opening/closing bodies 30 (opening/closing bodies 30A to 30E) provided in the vehicle body 32 is set as the imaging range of each of the imaging units 26. For example, each of the imaging units 26 is disposed at a position corresponding to the opening/closing body 30 (opening/closing bodies 30A to 30E). Then, the imaging units 26 each photograph the peripheral area P (peripheral areas P1 to P5) of its corresponding opening/closing body 30 (opening/closing bodies 30A to 30E) and acquire a moving image.

Further, in the present embodiment, it is assumed that the imaging unit 26 performs imaging using a wide-angle lens so as to acquire the moving image of the peripheral area P. However, the imaging performed by the imaging unit 26 is not limited to imaging using the wide-angle lens.

Further, since it is only necessary for the imaging unit 26 to be disposed at a position where it can photograph the peripheral area P of the opening/closing body 30, various existing cameras mounted for ensuring safety in the peripheral area of the vehicle 11 may be used as the imaging unit 26. For example, at least one of on-vehicle cameras (e.g., a camera mounted to a side mirror or a fender mirror, a back camera mounted at a rear part of the vehicle 11, a front imaging camera mounted at a front part of the vehicle 11, etc.) mounted on the vehicle 11 may be allowed to function as the imaging unit 26.

Referring back to FIG. 1, the reception unit 20 receives the first signal from the first terminal 12.

In the present embodiment, the controller 10 includes a plurality of reception units 20 (reception units 20A to 20E). The plurality of reception units 20 (reception units 20A to 20E) are provided so as to correspond respectively to the plurality of opening/closing bodies 30 (opening/closing bodies 30A to 30E). The plurality of reception units 20 (reception units 20A to 20E) each receive the first signal from the first terminal 12 positioned within a predetermined range from its corresponding opening/closing body 30 (opening/closing bodies 30A to 30E).

As described above, the first signal transmitted from the first terminal 12 is a signal of a strength that can reach the range of the first distance. Thus, the reception unit 20 becomes ready to receive the first signal from the first terminal 12 when the first terminal 12 is positioned within a range of the first distance from the reception unit 20.

Figure 5:
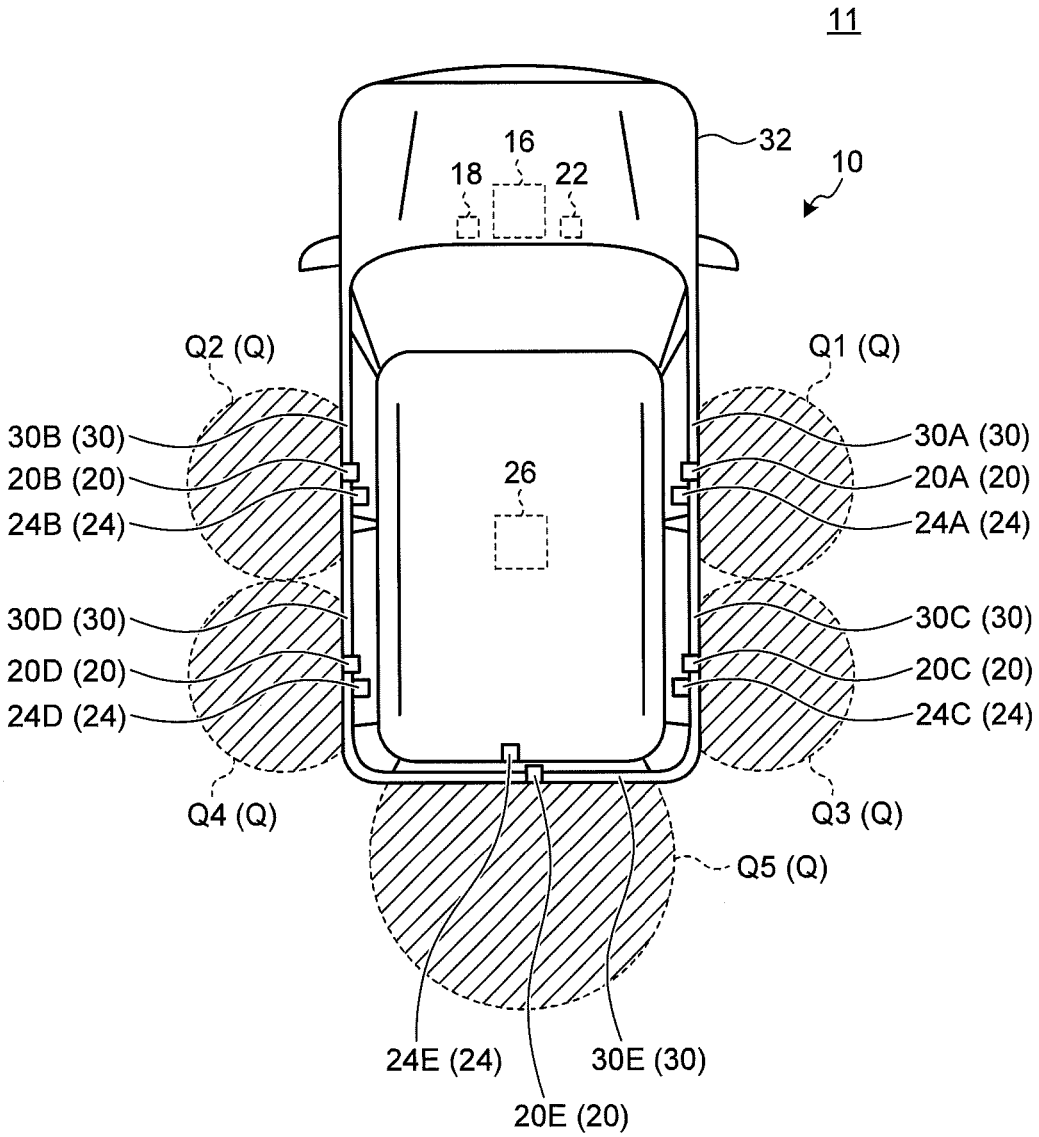
FIG. 5 is an exemplary view illustrating an arrangement of reception units and ranges within which the reception units can receive a first signal.

FIG. 5 is an exemplary view illustrating an arrangement of the reception units 20 and ranges within which the reception units 20 can receive the first signal.

As illustrated in FIG. 5, the reception unit 20A receives the first signal from the first terminal 12 positioned in an area Q1 of a predetermined range from the opening/closing body 30A. The reception unit 20A is provided near the opening/closing body 30A (e.g., an upper portion of the opening/closing body 30A of the vehicle body 32).

The reception unit 20B receives the first signal from the first terminal 12 positioned in an area Q2 of a predetermined range from the opening/closing body 30B. The reception unit 20B is provided near the opening/closing body 30B (e.g., an upper portion of the opening/closing body 30B of the vehicle body 32).

Similarly, the reception unit 20C receives the first signal from the first terminal 12 positioned in an area Q3 of a predetermined range from the opening/closing body 30C. The reception unit 20C is provided near the opening/closing body 30C (e.g., an upper portion of the opening/closing body 30C of the vehicle body 32). The reception unit 20D receives the first signal from the first terminal 12 positioned in an area Q4 of a predetermined range from the opening/closing body 30D. The reception unit 20D is provided near the opening/closing body 30D (e.g., an upper portion of the opening/closing body 30D of the vehicle body 32). The reception unit 20E receives the first signal from the first terminal 12 positioned in an area Q5 of a predetermined range from the opening/closing body 30E. The reception unit 20E is provided near the opening/closing body 30E (e.g., an upper portion of the opening/closing body 30E of the vehicle body 32).

Thus, when the first terminal 12 is positioned at one of the areas Q (areas Q1 to Q5), one of the reception units 20A to 20E that can receive the first signal transmitted from the first terminal 12 receives the first signal from the first terminal 12.

The area Q (areas Q1 to Q5 each in which the distance from the reception unit 20 is equal to or less than the first distance) within which the first signal can be received by each of the reception units 20A to 20E preferably coincides with the peripheral area P as the imaging range of the imaging unit 26. Further, a size of the area Q within which the first signal can be received by each of the reception units 20A to 20E is preferably smaller than a size of the peripheral area P of the opening/closing body 30 corresponding to each of the reception units 20A to 20E.

When a position of the first terminal 12 within the area Q changes, a relative distance between the first terminal 12 and the reception unit 20 (reception units 20A to 20E) that is receiving the first signal from the first terminal 12 changes. As a result, a reception strength of the first signal at the reception unit 20 changes. The strength of the first signal received by each of the reception units 20A to 20E is a strength of a degree that reaches the first distance range and is weaker than a signal transmitted from the second terminal 14. Thus, the change in the strength of the first signal to be received becomes conspicuous due to the position change of the first terminal 12 within the area Q.

Thus, in the present embodiment, the control unit 16 controls the opening/closing operation of the opening/closing body 30 by using the moving image photographed by the imaging unit 26 and change in the reception strength of the first signal received by the reception unit 20 (details of which will be described later).

The projection unit 24 projects, to the area Q of a predetermined range from the opening/closing body 30, a guidance image for inducing the subject 40 to perform a predetermined motion. The guidance image is, e.g., a linear image or a dot-like image. The subject 40 moves his or her body in response to the guidance image and can thereby perform a predetermined motion. Specifically, the subject 40 makes a motion of blocking the linear image or dot-like image as the guidance image or makes a motion along the guidance image and can thereby perform a predetermined motion.

The projection unit 24 is, e.g., a known projection device such as a projector, a light-emitting device that emits light according to the guidance image, or a light source that emits light according to the guidance image. The projection unit 24 projects the projection image to the area Q under control of the control unit 16.

Referring back to FIG. 1, the storage unit 18 stores various types of information. The storage unit 18 is, e.g., an HDD (Hard Disk Drive). In the present embodiment, the storage unit 18 previously stores the first and second information.

Figures 6A, 6B, 7:
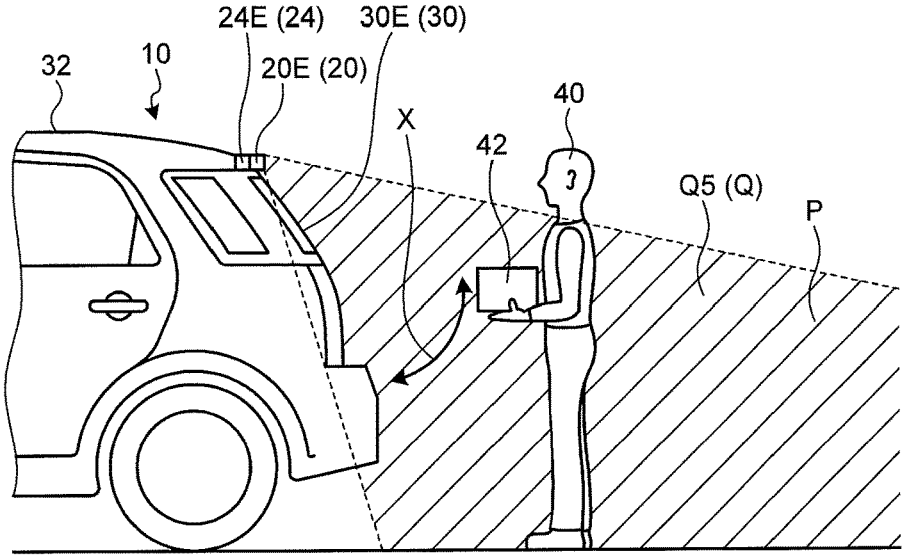
FIGS. 6A and 6B are views illustrating, as an example, data structures of first information and second information, respectively.
FIG. 7 is an exemplary view illustrating, in an enlarged manner, a rear part of a vehicle body.

FIGS. 6A and 6B are views illustrating, as an example, data structures of the first and second information, respectively.

FIG. 6A is a view illustrating an example of a data structure of the first information. The first information is data associating information indicating the motion of the subject 40 with change in the reception strength of the first signal. The first information may be provided in the form of a database, but not limited thereto.

The motion of the subject 40 corresponds to the above-mentioned predetermined motion. In the present embodiment, the motion of the subject 40 is a motion that can be performed even by the subject 40 who has the baggage(s) in both hands (see FIGS. 2A and 2B). Examples of the motion of the subject 40 include, e.g., a motion of the subject 40 moving his or her body upward/downward, a motion of the subject 40 moving his or her body leftward/rightward, a motion of the subject 40 moving his or her body forward/backward (a motion of approaching/separating from the opening/closing body 30 of the vehicle body 32), a motion of the subject 40 moving his or her head, and a motion of the subject 40 moving his or her foot.

The above-described motions may previously be set on the controller 10. Further, addition or change of the motion may be made by a user operation on an input unit (not illustrated).

Further, the above-described motions are each preferably a reciprocal motion and, more preferably, a reciprocal motion according to an opening/closing direction of the opening/closing body 30 to be opened/closed.

The reciprocal motion refers to a repetition of a series of motions in which a motion in a given direction is performed, followed by the same motion in the opposite direction. Specifically, the reciprocal motion is, e.g., a repetition of a series of motions in which the subject 40 spins his or her body to the right, followed by spinning the body to the left.

The reciprocal motion according to the opening/closing direction of the opening/closing body 30 refers to a reciprocal motion of the subject 40 moving his or her body leftward/rightward when the opening/closing body 30 is a slide type. FIG. 7 is an exemplary view illustrating, in an enlarged manner, a rear part of the vehicle body 32. For example, when the opening/closing body 30 (opening/closing body 30E) is a flip-up type door, the opening/closing body 30E is opened/closed in an arrow X direction of FIG. 7. Thus, in this case, the reciprocal motion according to the opening/closing direction is, e.g., a motion of the subject 40 in the up/down direction according to the opening/closing direction (arrow X direction) of the opening/closing body 30E.

Referring back to FIG. 6A, the information indicating each motion, stored in the first information is preferably information indicating an analysis result of the moving image of the subject 40 who performs the motion.

Note that the first information may be information associating identification information of each opening/closing body 30, information indicating the motion of the subject 40, and change in the reception strength. In this case, the motion corresponding to the identification information of the opening/closing body 30 indicates the motion according to the opening/closing direction of the opening/closing body 30 identified by the identification information.

The change in the reception strength indicates a change in the reception strength of the first signal transmitted from the first terminal 12 held by the subject 40 at the reception unit 20 occurring when the subject 40 performs the corresponding motion. The controller 10 may previously measure the change in the reception strength corresponding to each motion and register a result of the measurement in the first information.

Figure 8A:
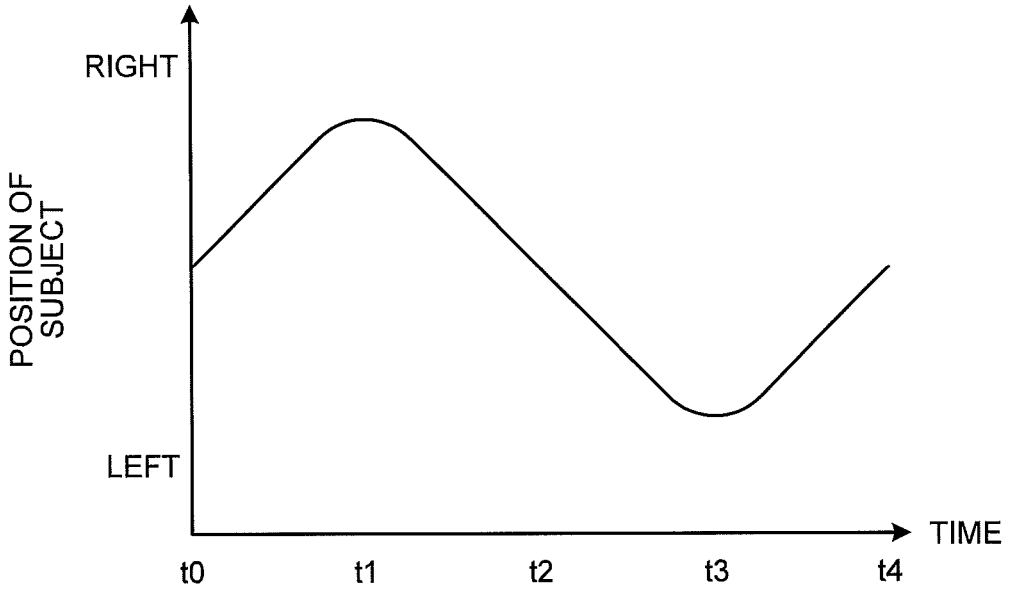
FIGS. 8A and 8B are graphs illustrating, as an example, a change in a position of the subject and a change in reception strength, respectively.
Figure 8B:
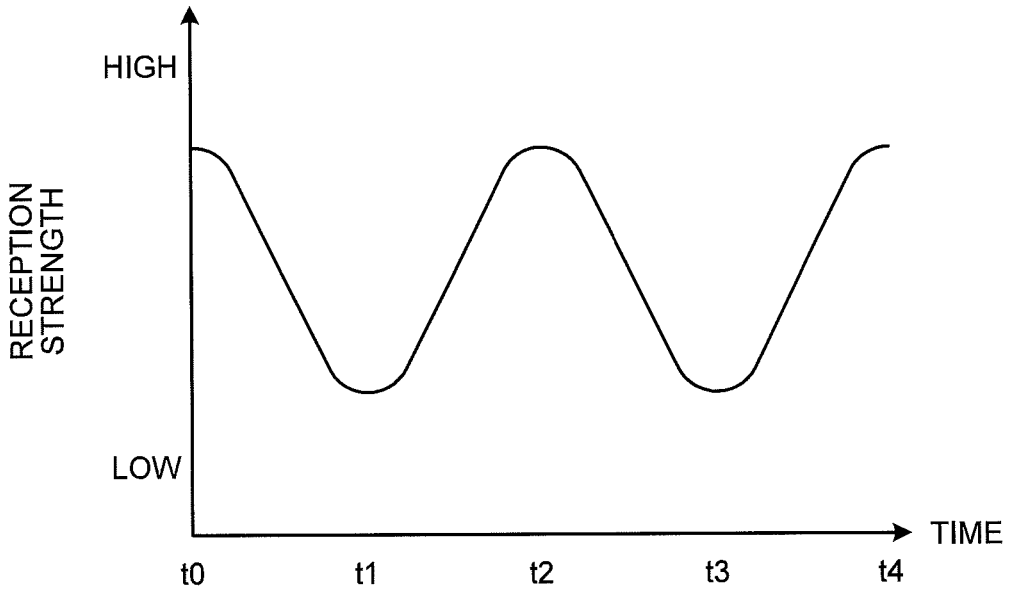

FIGS. 8A and 8B are graphs illustrating, as an example, a change in a position of the subject 40 and a change in the reception strength, respectively.

FIG. 8A illustrates an example of the change in the position of the subject 40 and FIG. 8B illustrates an example of the change of the reception strength.

FIG. 8B is an example of change in the reception strength of the first signal transmitted from the first terminal 12, which has been received by any one reception unit 20 out of the reception units 20A to 20E.

It is assumed, for example, that the subject 40 moves his or her body leftward/rightward with respect to a given reception unit 20, as illustrated in FIG. 8A. In this case, a detection unit 16C detects a motion of the subject 40 as follows: being positioned in front of the reception unit 20 as viewed from the imaging unit 26 at time t0, being positioned to the right of the reception unit 20 at time t1, being positioned in front of the reception unit 20 once again at time t2, being positioned to the left of the reception unit 20 at time t3, and being positioned in front of the reception unit 20 at time t4. As a detection method, any methods such as an existing object recognition technique and a motion vector analysis can be used.

Along with the detection of the motion as illustrated in FIG. 8A, the change in the reception strength at the same time is detected as illustrated in FIG. 8B. That is, a high reception strength is detected when the subject 40 is positioned in front of the reception unit 20, and the reception strength becomes lower as the subject 40 moves to the left or right. In short, a positional relationship and a distance between the first terminal 12 held by the subject 40 and the reception unit 20 change with the motion of the subject 40. Thus, the reception strength of the first signal to be received by the reception unit 20 changes in sync with the motion of the subject 40.

The controller 10 may measure the change in the reception strength of the first signal transmitted from the first terminal 12 held by the subject 40 at the reception unit 20 occurring when the subject 40 performs the corresponding motion in advance and register a result of the measurement in the first information.

FIG. 6B is a view illustrating an example of a data structure of the second information. The second information is data associating user identification information with use authority. The second information may be provided in the form of a database, but not limited thereto.

The user identification information is the same as the user identification information of the second terminal 14 held by the subject 40. The use authority is execution authority of various operations of the controller 10, which is given to a user identified by the corresponding user identification information. The use authority is, e.g., opening/closing authority for the opening/closing body 30. Note that the use authority is not limited to the opening/closing authority, but may be execution authority of various functions of the vehicle body 32 (main body part) on which the controller 10 is mounted. Further, one or more kinds of use authority may be given for each user identification information.

Referring back to FIG. 1, the control unit 16 is a computer including a CPU (Central Processing Unit) and controls the entire controller 10. The control unit 16 may be a circuit other than the CPU.

The control unit 16 includes an acceptance unit 16A, a projection control unit 16B, a detection unit 16C, an opening/closing control unit 16D, and a main body control unit 16E. Some or all of the acceptance unit 16A, the projection control unit 16B, the detection unit 16C, the opening/closing control unit 16D, and the main body control unit 16E may be realized by making a processing unit such as the CPU execute a program, i.e., by software, by hardware such as an IC (Integrated Circuit), or by using software and hardware in combination.

The control unit 16 may include at least the detection unit 16C and the opening/closing control unit 16D. That is, the control unit 16 may not include at least one of the acceptance unit 16A, the projection control unit 16B and the main body control unit 16E.

The detection unit 16C detects the motion of the subject 40 included in the moving image acquired by the imaging unit 26. In the present embodiment, the detection unit 16C controls the imaging unit 26 to start imaging when one of the reception units 20 (reception units 20A to 20E) provided in the vehicle body 32 receives the first signal transmitted from the first terminal 12.

In a case where the controller 10 includes a plurality of imaging units 26, the detection unit 16C activates the imaging unit 26 that covers, as the imaging range, an area Q corresponding to one of the reception units 20 that has received the first signal. As a result, imaging of the moving image of the peripheral area P of the opening/closing body 30 that the subject 40 approaches is started. In a case where the plurality of reception units 20 have received the first signal, the imaging unit 26 that covers, as the imaging range, an area Q corresponding to one of the reception units 20 that has the highest reception strength may be activated.

The detection unit 16C analyzes the moving image acquired by the imaging unit 26 to detect the motion of the subject 40 included in the moving image. The detection unit 16C may detect the motion of the subject 40 by using a known image analysis method.

The opening/closing control unit 16D controls the opening operation of the opening/closing body 30 when the motion of the subject 40 detected by the detection unit 16C and the change of the reception strength of the first signal received by the reception unit 20 change in sync with each other.

When the motion of the subject 40 detected by the detection unit 16C represents the predetermined motion registered in the first information, the opening/closing control unit 16D may determine whether or not there is a motion that coincides with the motion of the subject 40 that the detection unit 16C has detected from the moving image among the motions registered in the first information. When there is a motion that coincides with the motion of the subject 40, the opening/closing control unit 16D reads, from the first information, the change in the reception strength corresponding to the motion.

Then, the opening/closing control unit 16D determines whether or not the change in the reception strength of the first signal received by the reception unit 20 during the motion coincides with the change in the reception strength read from the first information. Note that the opening/closing control unit 16D may determine that the change in the reception strength of the first signal received by the reception unit 20 coincides with the change in the reception strength read from the first information not only when both the changes completely coincide with each other, but also when both the changes have the same regularity in the change in the strength within a predetermined range. Then, when the both changes coincide with each other, the opening/closing control unit 16D determines that the change in the reception strength of the first signal received by the reception unit 20 during a predetermined time period in which the subject 40 performs the motion represents a change according to the motion.

Then, when the motion of the subject 40 detected by the detection unit 16C represents the predetermined motion, and when the change in the reception strength of the first signal received by the reception unit 20 during the motion represents a change according to the motion, the opening/closing control unit 16D controls the opening operation of the opening/closing body 30.

Thus, the opening/closing control unit 16D controls the opening operation of the opening/closing body 30 when the motion of the subject 40 detected from the moving image of the subject 40 acquired by the imaging unit 26 and change in the reception strength of the first signal received from the first terminal 12 represent the same motion of the subject 40.

Specifically, the opening/closing control unit 16D controls the drive unit 28 to bring the opening/closing body 30 to be opened into the opening motion. Note that the opening/closing control unit 16D may determine the opening/closing body 30 corresponding to the reception unit 20 that has received the first signal as the opening/closing body 30 to be opened.

In a case where a plurality of opening/closing bodies 30 (opening/closing bodies 30A to 30E) and a plurality of reception units 20 (reception units 20A to 20E) corresponding, respectively, to the opening/closing bodies 30A to 30E are provided in the vehicle body 32, the opening/closing control unit 16D preferably performs control as follows.

That is, when the motion of the subject 40 detected by the detection unit 16C represents the predetermined motion, and when the change in the reception strength of the first signal received by the reception unit 20 during the motion represents a change according to the motion, the opening/closing control unit 16D may control the opening operation of the opening/closing body 30 (one of the opening/closing bodies 30A to 30E) that corresponds to the reception unit 20 (one of the reception units 20A to 20E) that has received the first signal. In a case where the plurality of reception units 20 have received the first signal, the opening/closing control unit 16D may determine the opening/closing body 30 corresponding to the reception unit 20 that has the highest reception strength as the opening/closing body 30 to be opened.

The projection control unit 16B controls, when the first terminal 12 is positioned within a given area Q, the projection unit 24 to project a guidance image to the area Q. For example, it is assumed that the subject 40 holding the first terminal 12 approaches the opening/closing body 30 of the vehicle body 32 and positioned within the area Q. Then, the projection unit 24 projects the guidance image to the area Q. Thus, by performing a motion according to the guidance image, the subject 40 who has approaches the opening/closing body 30 of the vehicle body 32 can easily perform the predetermined motion.

The acceptance unit 16A accepts, when the reception unit 20 receives the first signal, the user identification information from the second terminal 14 through the communication unit 22. When the reception unit 20 has received the first signal, the acceptance unit 16A transmits the user identification acquisition request to the second terminal 14. Upon receiving the acquisition request, the second terminal 14 transmits the user identification information stored in the storage unit 14B to the controller 10. The acceptance unit 16A of the controller 10 accepts the user identification information.

In the configuration in which the controller 10 includes the acceptance unit 16A, the opening/closing control unit 16D preferably performs control as follows. That is, the opening/closing control unit 16D determines whether or not the user identification information that has been accepted by the acceptance unit 16A is the user identification information of a user who has the opening/closing authority for the opening/closing body 30. The opening/closing control unit 16D makes this determination by searching the second information (see FIG. 6B) to determine whether or not the user has the opening/closing authority by determining whether or not the opening/closing authority is included in the use authority corresponding to the accepted user identification information. Then, when it is determined that the user identification information that has been accepted by the acceptance unit 16A is the user identification information of a user who has the opening/closing authority, when the motion of the subject 40 detected by the detection unit 16C represents the predetermined motion, and when the change in the reception strength of the first signal received by the reception unit 20 during the motion represents a change according to the motion, the opening/closing control unit 16D preferably controls the opening operation of the opening/closing body 30.

The main body control unit 16E controls the main body (in the present embodiment, the vehicle 11) on which the controller 10 is mounted. The main body control unit 16E performs known processing of controlling the vehicle 11. The main body control unit 16E may be separately provided from the controller 10 in the vehicle 11. In this case, the controller 10 and the main body control unit 16E may be connected to each other so as to be able to exchange data and signals therebetween.

Figure 9:
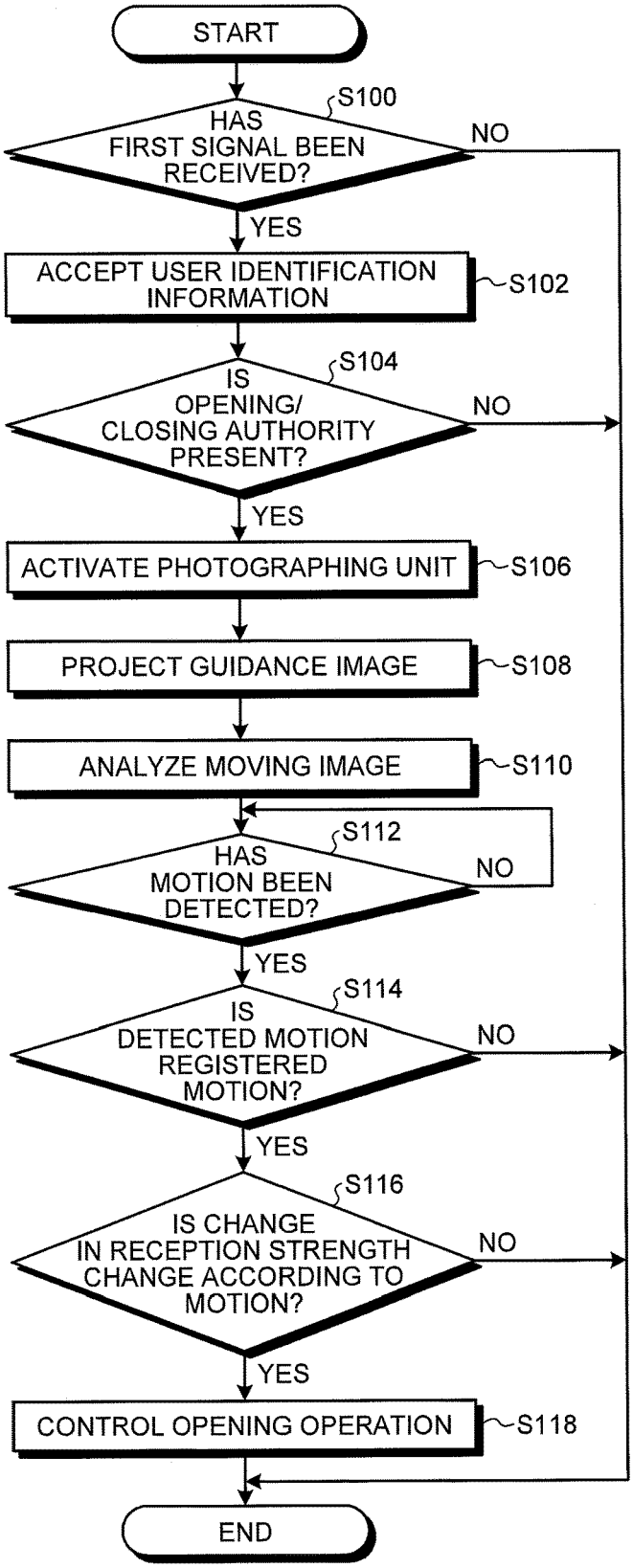
FIG. 9 is a flowchart illustrating a procedure of control processing.

FIG. 9 is a flowchart illustrating a procedure of control processing executed by the controller 10 according to the present embodiment.

The detection unit 16C determines whether or not the reception unit 20 has received the first signal (step S100). More in detail, the detection unit 16C determines whether or not one of the plurality of reception units 20 (reception units 20A to 20E) provided in the vehicle body 32 has received the first signal. That is, the detection unit 16C determines whether or not the first terminal 12 is positioned within the area Q within which the reception unit 20 can receive the first signal.

When a negative determination is made in step S100 (No in step S100), this routine is ended; on the other hand, when it is determined that the reception unit 20 has received the first signal (Yes in step S100), the procedure proceeds to step S102.

Then, the acceptance unit 16A accepts the user identification information from the second terminal 14 owned by the subject 40 who holds the first terminal 12 that transmits the first signal that has been received in step S100 (step S102).

Then, the opening/closing control unit 16D determines whether or not the user identification information accepted in step S102 is the identification information of a user who has the opening/closing authority for the opening/closing body 30 (step S104). When a negative determination is made in step S104 (No in step S104), this routine is ended; on the other hand, when a positive determination is made in step S104 (Yes in step S104), the procedure proceeds to step S106.

Then, the detection unit 16C controls the imaging unit 26 to start imaging (step S106). In a case where the controller 10 includes a plurality of imaging units 26, the detection unit 16C activates the imaging unit 26 that covers, as the imaging range, an area Q corresponding to the reception unit 20 (one of reception units 20A to 20E) that has received the first signal in step S100. As a result of the processing of step S106, imaging of the moving image of the peripheral area P of the opening/closing body 30 is started.

Then, the projection control unit 16B controls the projection unit 24 to project the guidance image to the area Q (step S108). In a case where the controller 10 includes a plurality of projection units 24 (projection units 24A to 24E), the projection control unit 16B controls the projection unit 24 (one of the projection units 24A to 24E) to project the guidance image to the peripheral area P (one of the peripheral areas P1 to P5) of the opening/closing body 30 (one of the opening/closing bodies 30A to 30E) corresponding to the reception unit 20 (one of the reception units 20A to 20E) that has received the first signal in step S100.

As a result of the processing of step S108, the guidance image is projected to the peripheral area P (one of the peripheral areas P1 to P5) of the opening/closing body 30 (one of the opening/closing bodies 30A to 30E) near the subject 40. Thus, by performing a motion according to the guidance image, the subject 40 can easily perform the predetermined motion.

Then, the detection unit 16C analyzes the moving image acquired by the imaging unit 26 (step S110). Then, the detection unit 16C determines whether or not the motion of the subject 40 has been detected from the moving image (step S112). The detection unit 16C repeatedly makes a negative determination until the motion is detected (No in step S112). When it is determined that the motion has been detected (Yes in step S112), the procedure proceeds to step S114.

Then, the detection unit 16C determines whether or not information indicating the motion detected in step S112 is the motion that has previously been registered in the first information (step S114). In a case where the identification information of the opening/closing body 30, information indicating the motion, and change in the reception strength are stored in the first information in association with one other, the following determination is preferably made. That is, in this case, the detection unit 16C determines whether or not information indicating the motion, which corresponds to the identification information of the opening/closing body 30 (one of the opening/closing bodies 30A to 30E) corresponding to one of the plurality of reception units 20 (any reception units 20A to 20E) that has received the first information in step S100 and information indicating the motion, which is detected in step S112, coincide with each other.

When the motion detected in step S112 is not the motion registered in the first information (No in step S114), this routine is ended; on the other hand, when the motion detected in step S112 is the motion registered in the first information (Yes in step S114), the procedure proceeds to step S116.

In step S116, the opening/closing control unit 16D determines whether or not the change in the reception strength of the first signal received by the reception unit 20 (the reception unit 20 that has received the first signal in step S100) during the motion detected in step S112 is the change according to the motion (step S116). When the change in the reception strength of the first signal received by the reception unit 20 is not the change according to the motion (No in step S116), this routine is ended; on the other hand, when the change in the reception strength of the first signal received by the reception unit 20 is the change according to the motion (Yes in step S116), the procedure proceeds to step S118.

In step S118, the opening/closing control unit 16D controls the opening operation of the opening/closing body 30 (step S118). After that, this routine is ended. In a case where the controller 10 includes a plurality of opening/closing bodies 30 (opening/closing bodies 30A to 30E), the opening/closing control unit 16D controls the opening operation of the opening/closing body 30 (one of the opening/closing bodies 30A to 30E) that corresponds to the reception unit 20 (one of the reception units 20A to 20E) that has received the first signal in step S100.

As a result, when the subject 40 standing in front of the opening/closing body 30 of the vehicle 11 performs a predetermined motion, the opening/closing body 30 is opened.

Note that the same function can be achieved even when the processing of step S108 and step S114 are omitted in the procedure of the control processing executed by the controller 10 described using FIG. 9.

As described above, the controller 10 of the present embodiment includes the imaging unit 26, reception unit 20, the detection unit 16C, and the opening/closing control unit 16D. The imaging unit 26 acquires the image of the peripheral area P of the opening/closing body 30 provided in the main body part (vehicle body 32). The reception unit 20 receives, from the first terminal 12 that transmits the first signal of a predetermined strength, the first signal. The detection unit 16C detects the motion of the subject 40 included in the image. The opening/closing control unit 16D controls the opening operation of the opening/closing body 30 when the change in the reception strength of the first signal received by the reception unit 20 represents the change synchronizing with the detected motion of the subject 40.

Thus, the controller 10 of the present embodiment detects the motion of the subject 40 from the moving image of the subject 40 positioned within the peripheral area P of the opening/closing body 30 and controls the opening operation of the opening/closing body 30 when the reception strength of the first signal received from the first terminal 12 held by the subject 40 represents the change synchronizing with the detected motion.

As a result, the controller 10 of the present embodiment can prevent occurrence of malfunction of the opening operation of the opening/closing body 30.

For example, as illustrated in FIGS. 2A and 2B, when the subject 40 whose both hands are busy with the baggage 42 performs a predetermined motion in front of the opening/closing body 30 of the vehicle 11, the controller 10 can open the opening/closing body 30 while preventing the malfunction.

Further, the controller 10 preferably includes the projection unit 24 and the projection control unit 16B. With this configuration, it is possible to induce the subject 40 to perform a predetermined motion.

Further, the controller 10 accepts the user identification information from the second terminal 14 when the reception unit 20 receives the first signal. In this case, the opening/closing control unit 16D controls the opening operation of the opening/closing body 30 when the accepted user identification information is the user identification information of a user who has the opening/closing authority for the opening/closing body 30, when the predetermined motion of the subject 40 is detected, and when the reception strength of the first signal represents a change according to the motion.

Thus, the controller 10 can prevent the malfunction of the opening operation for the opening/closing body 30 more effectively and can enhance security.

Further, the predetermined motion is preferably a motion according to the opening/closing direction of the opening/closing body 30 to be opened/closed. In this case, in addition to the above effects, the controller 10 can enhance convenience of the subject 40 in controlling the opening operation.

Further, in a case where the reception units 20 are provided so as to correspond to the plurality of respective opening/closing bodies 30, the opening/closing control unit 16D controls the opening operation of the opening/closing body 30 corresponding to the reception unit 20 that has received the first signal when the predetermined motion of the subject 40 is detected, and when the reception strength of the first signal represents a change according to the motion.

Thus, in addition to the above effects, the controller 10 can selectively open one of the plurality of opening/closing bodies 30 (opening/closing bodies 30A to 30E) in front of which the subject 40 is positioned.

In the above embodiment, the controller 10 is mounted on the vehicle 11. However, the mounting object on which the controller 10 is mounted is not limited to the vehicle 11, but may be any object having the opening/closing body 30. For example, the controller 10 may be provided in a building having the opening/closing body 30, an area having the opening/closing body 30 (e.g., parking area having the opening/closing body 30 at a gateway), or the like.

Figure 10:
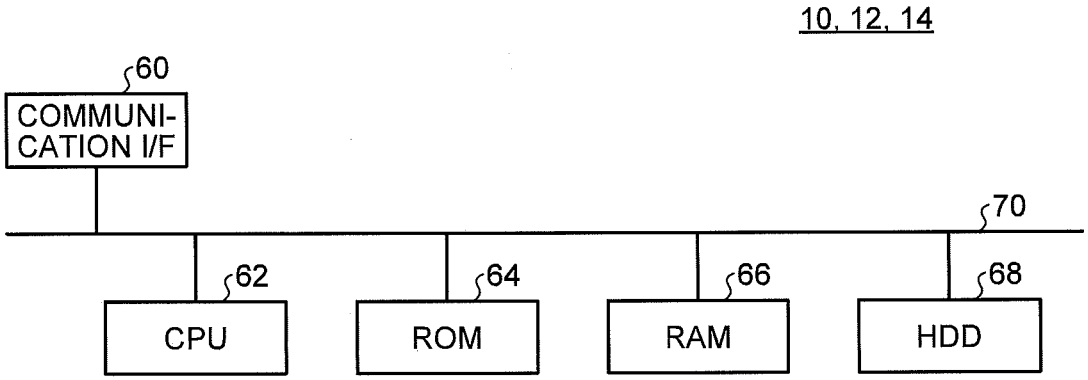
FIG. 10 is a block diagram illustrating a hardware configuration example.

The following describes a hardware configuration of each of the controller 10, the first terminal 12, and the second terminal 14 according to the above embodiment. FIG. 10 is a block diagram illustrating a hardware configuration example of each of the controller 10, the first terminal 12, and the second terminal 14 according to the above embodiment.

The controller 10, the first terminal 12, and the second terminal 14 according to the above embodiment each have a hardware configuration using an ordinary computer, in which a communication I/F 60, a CPU 62, a ROM 64, a RAM 66, and an HDD 68 are connected to one another by a bus 70.

The CPU 62 is an arithmetic unit that controls the entire processing of each of the controller 10, the first terminal 12, and the second terminal 14 according to the above embodiment. The RAM 66 stores data required for the CPU 62 to perform various processing. The ROM 64 stores a program for realizing various processing to be performed by the CPU 62. The HDD 68 stores data to be stored in the above-mentioned storage unit 18 or storage unit 14B. The communication I/F 60 is an interface connected to an external device or an external terminal through a communication line so as to exchange data with the connected external device or external terminal.

A program for executing the search processing to be executed in each of the controller 10, the first terminal 12, and the second terminal 14 according to the above embodiment may be provided by being previously implemented in the ROM 64.

The program for executing the above processing to be executed in each of the controller 10, the first terminal 12, and the second terminal 14 according to the above embodiment may be provided by being recorded in an installable form or an executable form in a computer readable storage medium, such as a CD-ROM, a flexible disk (FD), a CD-R, a DVD (Digital Versatile Disk), or the like.

Alternatively, the program for executing the above processing to be executed in each of the controller 10, the first terminal 12, and the second terminal 14 according to the above embodiment may be provided by being stored in a computer connected to a network such as Internet and downloaded over the network. Further alternatively, the program for executing the above processing to be executed in each of the controller 10, the first terminal 12, and the second terminal 14 according to the above embodiment may be provided or distributed over a network such as Internet.

Still further alternatively, the program for executing the above processing to be executed in each of the controller 10, the first terminal 12, and the second terminal 14 according to the above embodiment has a module structure made up of the above-described units. As actual hardware, the CPU 62 reads the program for executing the above processing from a storage medium such as the ROM 64 and executes the program to load the units on a main memory, thereby generating the above units on the main memory.

According to the present invention, it is possible to prevent occurrence of the malfunction of the opening operation of the opening/closing body.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A controller mounted on a vehicle, comprising:

an imaging unit configured to acquire a moving image of a peripheral area of an opening/closing body provided in a vehicle body;

a reception unit configured to receive, from a first terminal that transmits a first signal of a predetermined strength, the first signal;

a memory that stores information that defines associations between predetermined motions of a subject with respective changes in reception strength of the first signal;

a detection unit configured to detect a motion of the subject included in the moving image;

a projection unit configured to project a guidance image within an area of a predetermined range, wherein the guidance image instructs the subject to perform a predetermined motion, and the predetermined motion is a motion performed by the subject in a direction that corresponds to an opening/closing direction of the opening/closing body to be opened/closed;

a projection control unit configured to control the projection unit to project the guidance image when the first terminal is positioned within the range; and an opening/closing control unit configured to control an opening operation of the opening/closing body in response to recognizing that the motion of the subject detected from the moving image of the subject is the predetermined motion of the subject and that a change in the reception strength of the first signal received from the first terminal coincides with one of the changes in the reception strength defined by the information as being associated with the predetermined motion.

2. The controller according to claim 1, wherein the area of the predetermined range is an area from which the reception unit receives the first signal from the first terminal.

3. The controller according to claim 1, comprising:

a communication unit configured to communicate with a second terminal that stores therein user identification information; and an acceptance unit configured to accept, through the communication unit, the user identification information from the second terminal when the reception unit receives the first signal, wherein the opening/closing control unit is further configured to control the opening operation of the opening/closing body in response to determining that the accepted user identification information is user identification information of a user who has opening/closing authority for the opening/closing body.

4. A control method executed in a controller mounted on a vehicle, the method comprising steps of:

imaging a moving image of a peripheral area of an opening/closing body provided in a vehicle body;

receiving, from a first terminal that transmits a first signal of a predetermined strength, the first signal;

storing information that defines associations between predetermined motions of a subject with respective changes in reception strength of the first signal;

detecting a motion of the subject included in the moving image;

in response to determining that the first terminal is positioned within a predetermined range, projecting a guidance image within an area of the predetermined range, wherein the guidance image instructs the subject to perform a predetermined motion having a direction similar to an opening/closing direction of the opening/closing body to be opened/closed; and controlling an opening operation of the opening/closing body in response to determining that the motion of the subject detected from the moving image of the subject is the predetermined motion and that a change in the reception strength of the first signal received from the first terminal coincides with one of the changes in reception strength defined by the information as being associated with the predetermined motion.

5. A non-transitory computer-readable recording medium that stores therein a control program causing a computer, mounted on a vehicle, to execute a control method as set forth in claim 4.

* * * * *